US006233786B1

(12) United States Patent
Lin

(10) Patent No.: US 6,233,786 B1
(45) Date of Patent: May 22, 2001

(54) HANDLE FOR A BAG

(76) Inventor: Bo-Hon Lin, No. 311, Liu Chiau E. Road, Wapei Village, Pu Hsin Hsiang, Chang Hua Hsien (TW)

( * ) Notice: Subject to any disclaimer, the term of this patent is extended or adjusted under 35 U.S.C. 154(b) by 0 days.

(21) Appl. No.: 09/390,373

(22) Filed: Sep. 7, 1999

(51) Int. Cl.[7] ..... A45C 3/04

(52) U.S. Cl. ..... 16/443; 16/422; 16/114.1; 24/30.5 P; 383/13; 383/16; 383/24

(58) Field of Search ..... 16/406, 407, 444, 16/443, 422, 114.1, DIG. 12; 383/6, 13, 15, 16, 29, 24; 294/27.1, 31.2, 31.1; 24/587, 30.5 P

(56) References Cited

U.S. PATENT DOCUMENTS

| | | | | |
|---|---|---|---|---|
| 3,266,711 | * | 8/1966 | Song | 383/13 |
| 3,529,317 | * | 9/1970 | Schwarzkopf | 16/407 |
| 3,811,543 | * | 5/1974 | Parrochia | 383/41 |
| 4,000,768 | * | 1/1977 | Siegel | 383/23 |
| 4,787,754 | * | 11/1988 | Herrington | 24/587 |
| 4,871,264 | * | 10/1989 | Robbins, III et al. | 383/68 |
| 5,088,667 | * | 2/1992 | Olson | 248/101 |

* cited by examiner

*Primary Examiner*—Chuck Y. Mah
(74) *Attorney, Agent, or Firm*—Rosenberg, Klein & Lee

(57) ABSTRACT

A handle for a bag includes two parts each connected to a top edge of the bag. Each part includes a first plate which has a groove defined in one of two sides thereof and a second plate pivotally connected to the first plate. The second plate has a stick extending from one of two sides thereof so that the top edge of the bag and the stick are together fitted in the groove of the first plate.

2 Claims, 8 Drawing Sheets

HANDLE FOR A BAG

FIELD OF THE INVENTION

The present invention relates to a handle for a bag, and more particularly, to a handle comprising two parts and each having a groove and a ridge which is received in the groove with the top edge of the bag.

BACKGROUND OF THE INVENTION

A conventional shopping bag is shown in FIG. 1 and includes a bag 11 with an open top and a handle 12 which is connected to each side defining the open top of the bag 11. In order to securely connect the handle to the bag 11, a heating means 10 is used to connect the handle 12 to the bag 11 wherein the heating means 10 has a heat bar 101 so that the plastic material of the bag 11 and the handle 12 are melted and combined together. It takes a lot of time to combine the handle 12 and the bag 11 one by one. The time for the contact between the heat bar 101 and the bag 11 and the handle 12 decides the quality of the combination of the handle 12 and the bag 11. If the heating time is not long enough, the handle 12 could be disengaged from the bag 11 if a load in the bag 11 is heavy. If the time for combining the handle 12 and the bag 11 is too long, there could be tiny holes in the bag 11. Furthermore, referring to FIG. 2, because the heat, there will be wrinkles 13 on the outside of the bag 11 and the wrinkles 13 makes the bag 11 not meet aesthetic purpose.

The present invention intends to provide a handle for a bag and the handle includes a groove and a ridge so that the top edge of the bag is clamped in the groove by the ridge. The structure of the handle for a bag allows the manufacturers to connect the handle to the bag quickly and the inherent shortcomings of the conventional handle for a bag are mitigated.

SUMMARY OF THE INVENTION

In accordance with one aspect of the present invention, a handle for a bag is provided and comprises two identical parts each of which is connected to one of two opposite top edges of the bag. Each part has a first plate with a groove defined in one of two sides thereof and a stick is force-fitted in the groove with the top edge of the bag clamped between the stick and the first plate in the groove.

The main object of the present invention is to provide a handle for a bag wherein the top edge of the bag is clamped between a stick and a plate of the handle so that there will be no wrinkles as the conventional shopping bag.

Another object of the present invention is to provide a handle for a bag wherein no heating machine is needed to connect the handle to the bag.

Further objects, advantages, and features of the present invention will become apparent from the following detailed description with appropriate reference to the accompanying drawings.

DETAILED DESCRIPTION OF THE PREFERRED EMBODIMENTS

Figure 1:
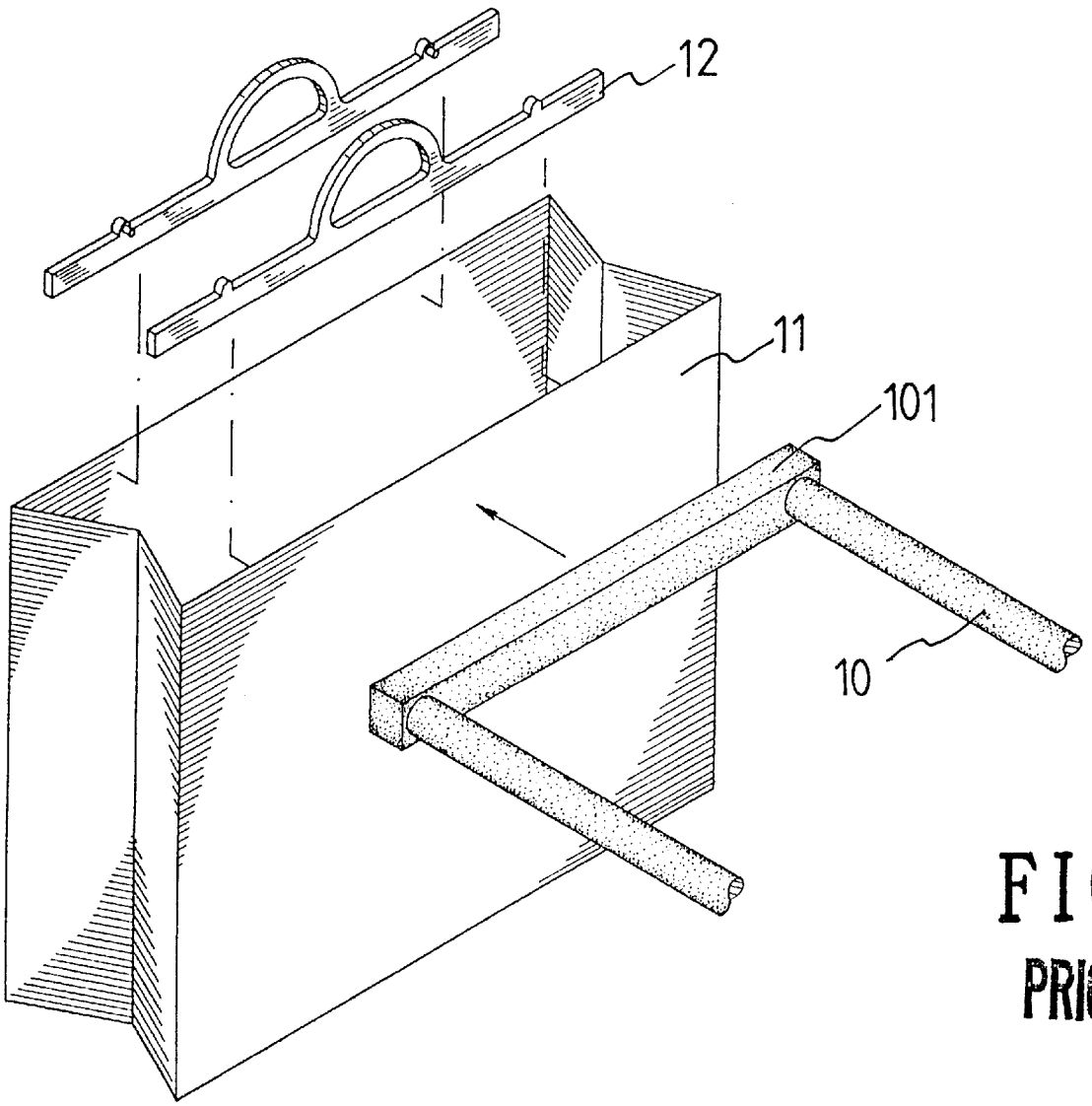
FIG. 1 PRIOR ART
FIG. 1 is an exploded view of the conventional handle, the bag and the heating means.
Figure 2:
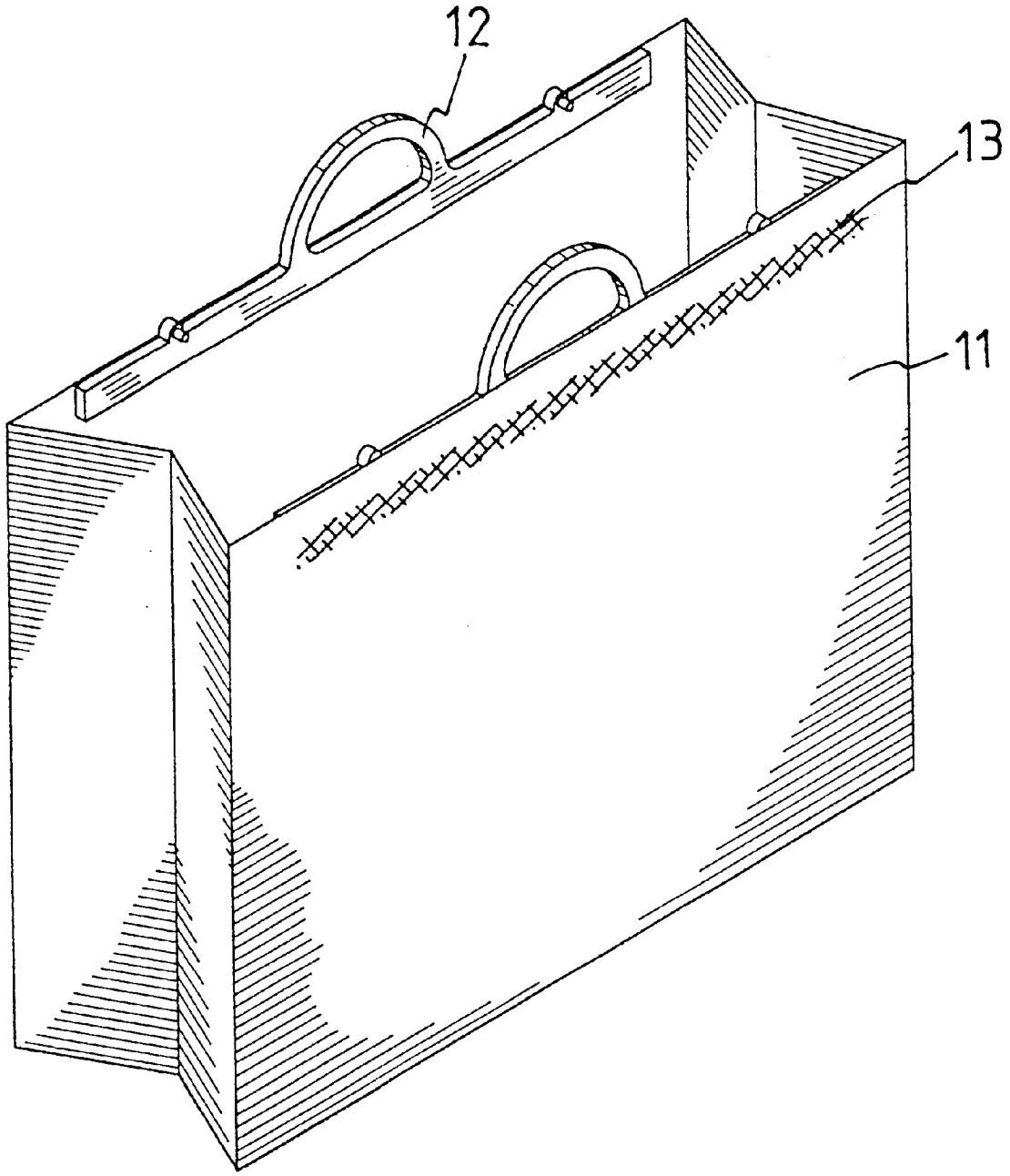
FIG. 2 PRIOR ART
FIG. 2 is a perspective view of the bag with the conventional handle connected thereto and wrinkles are seen for outside of the bag.
Figures 3, 4, 5:
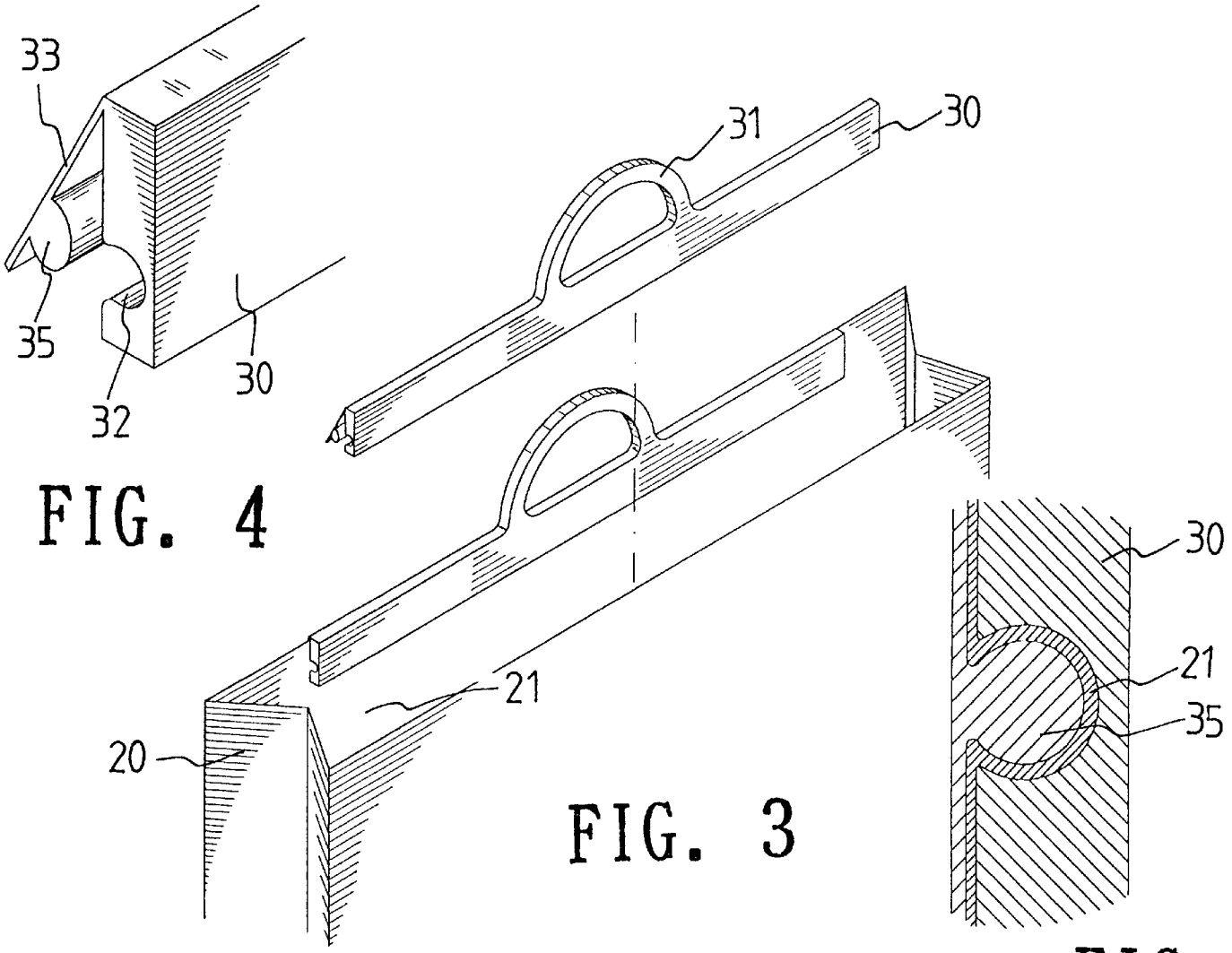
FIG. 3 is an exploded view of the handle in accordance with the present invention and a bag.
FIG. 4 is a perspective view to show the first plate and the second plate of the handle in accordance with the present invention.
FIG. 5 is a side elevational view, partly in section, of the combination of the stick and the top edge of the bag that are received in the groove of the first plate of the handle in accordance with the present invention.
Figure 6:
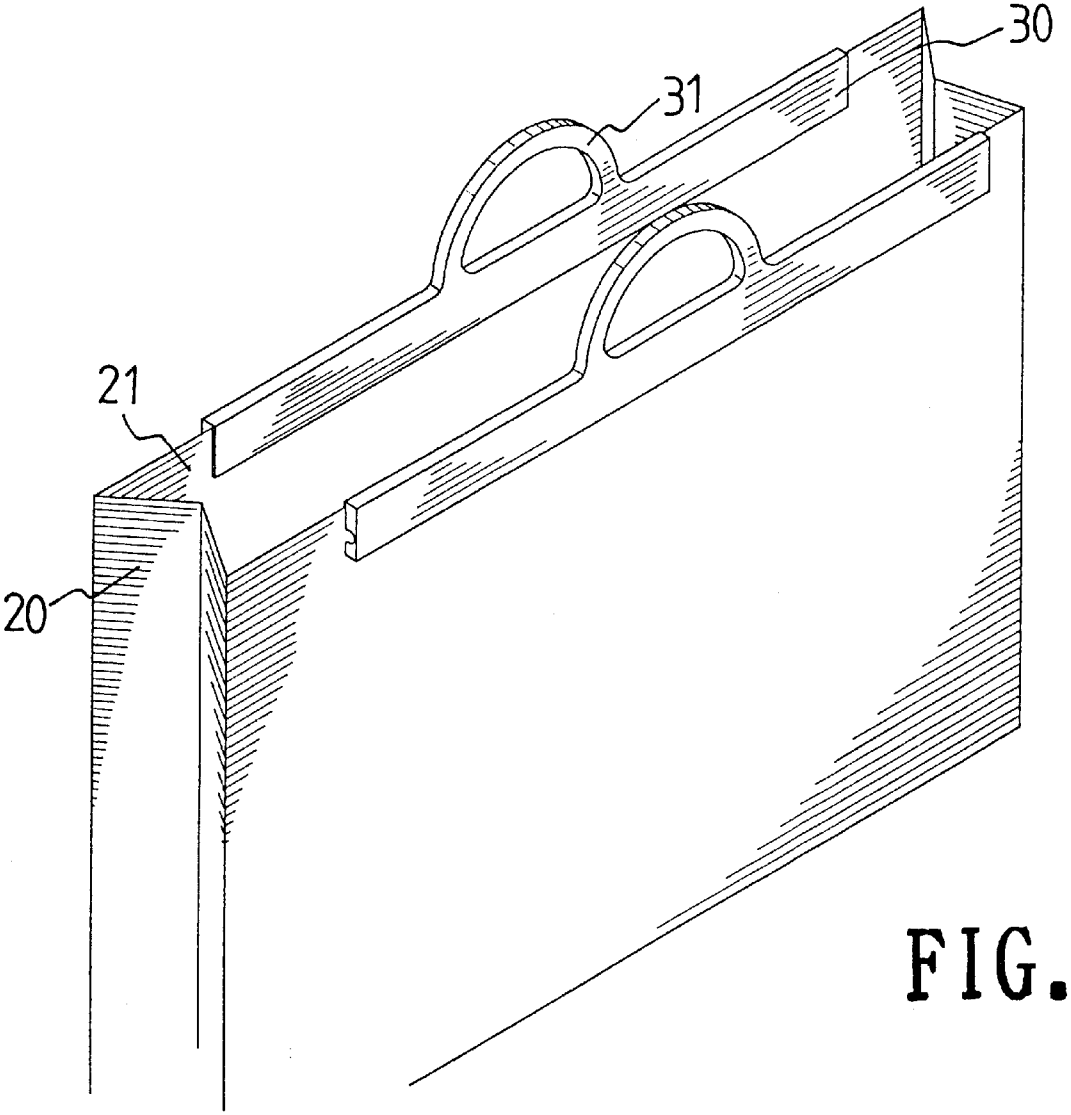
FIG. 6 is a perspective view to show the bag with the handle in accordance with the present invention connected thereto.

Referring to FIGS. 3 to 5, the handle of the present invention comprises two identical parts and each part is connected to one of two opposite top edge 21 of the bag 20. Each part has a first plate 30 having a grip member 31 connected thereto and a groove 32 defined in a side of the first plate 30. A second plate 33 is pivotally connected to the first plate 30 and the second plate 33 has a stick 35 extending from one of two ends thereof. The groove 32 has a narrow opening so that the top edge 21 of the bag 20 can be received in the groove 32 and the second plate 33 is pivoted toward the first plate 30 to force-fit the stick 35 in the groove 32 so that the top edge 21 of the bag 20 is securely clamped by the first plate 30 and the second plate 33.

Figure 7:
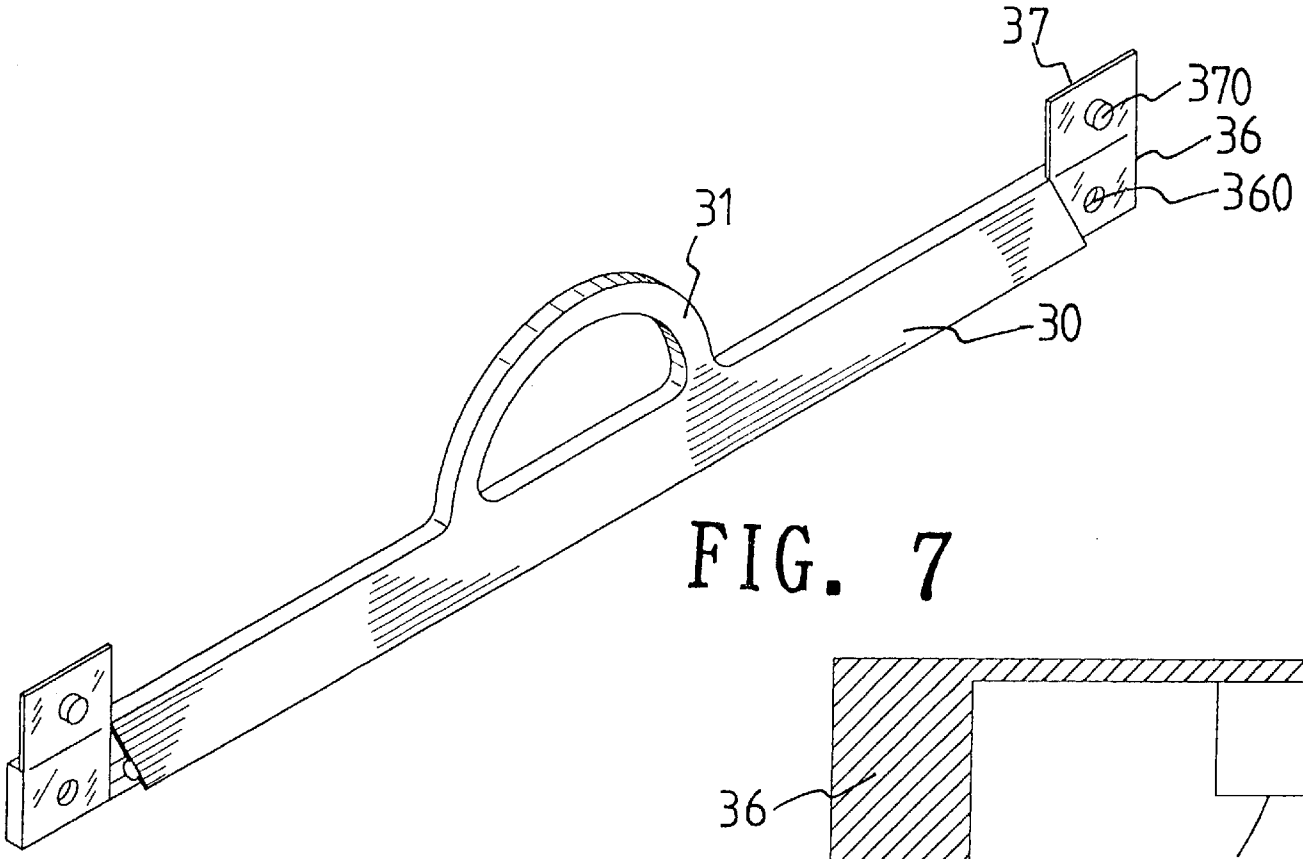
FIG. 7 is a perspective view of another embodiment of the handle in accordance with the present invention.
Figure 8:
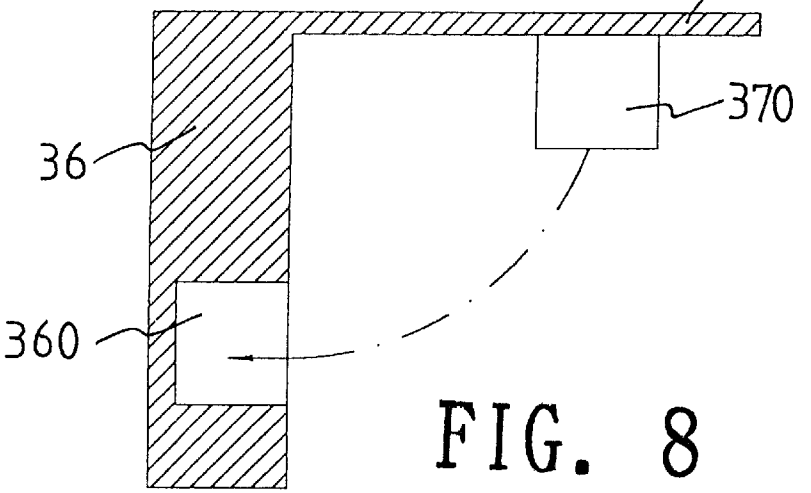
FIG. 8 is a side elevational view to show the extension and the tab of the handle as shown in FIG. 7.
Figure 9:
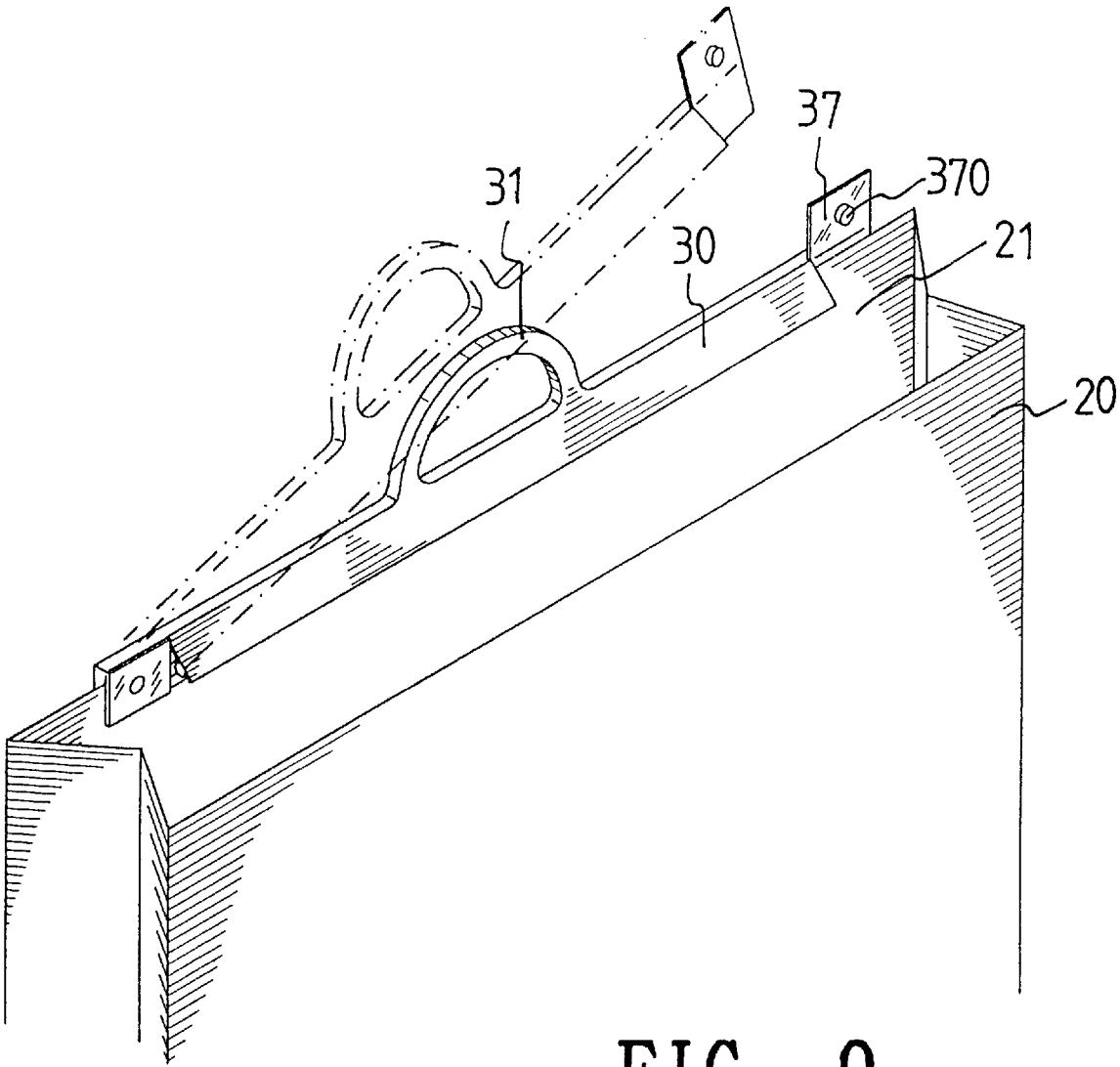
FIG. 9 is an illustrative view to illustrate the handle as shown in FIG. 7 is connected to the bag.

FIGS. 7 to 9 show another embodiment of the handle wherein two extensions 36 respectively extend from two ends of the first plate 30 and each extension 36 has a recess 360 defined therein. A tab 37 is pivotally connected to each extension 36 and each tab 37 has a boss 370 extending therefrom so as to be engaged with the recess 360. When assembling the handle, one of the sets of the extension 36 and the tab 37 is first clamp the top edge 21 of the bag 20 by inserting the top edge 21 in the recess 360 and clamped by the boss 370. The handle is pivoted about the boss 370 and to connect the other set of the extension 36 and the tab 37.

Figure 10:
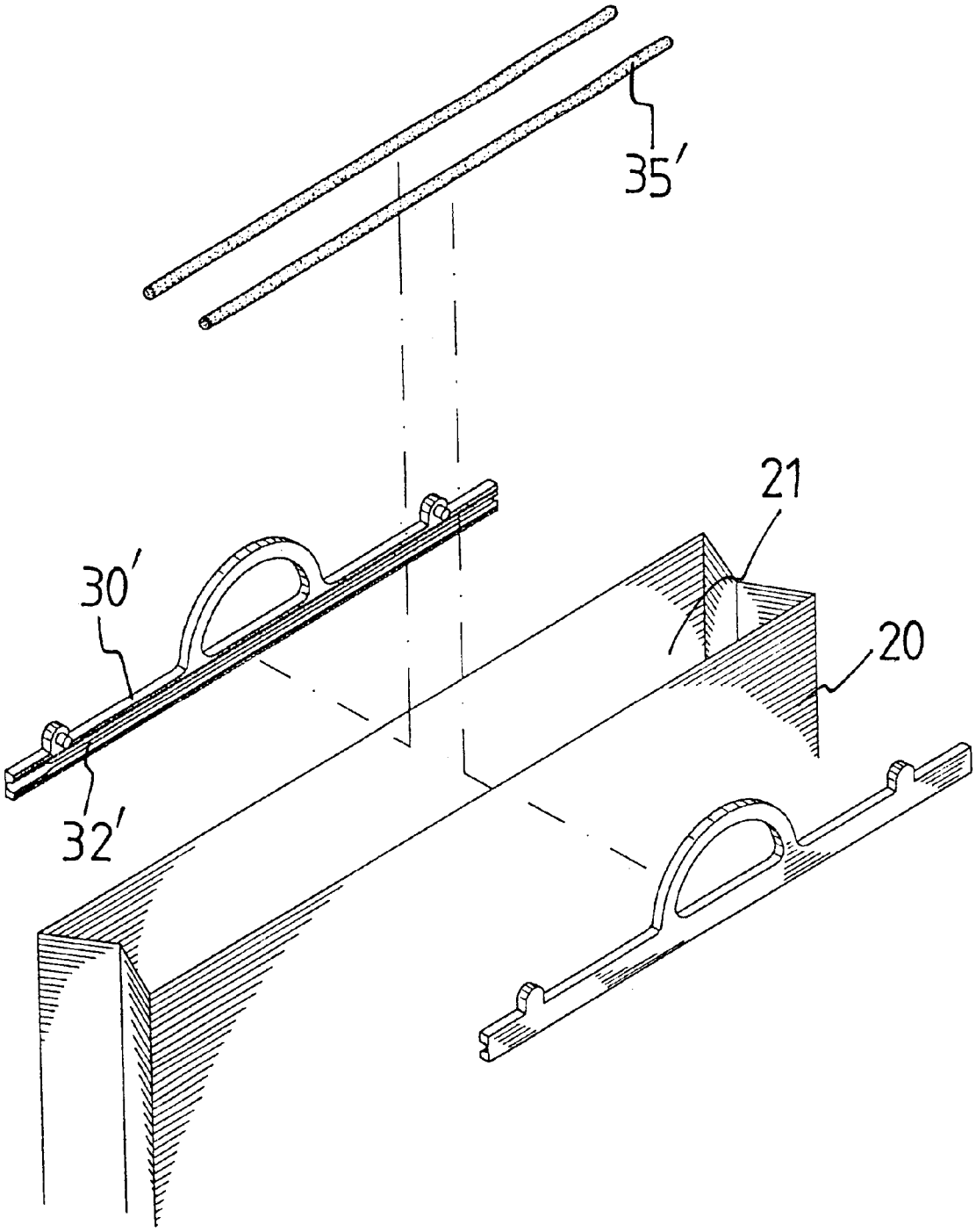
FIG. 10 is an exploded view of yet another embodiment of the handle in accordance with the present invention and a bag.
Figures 11, 12:
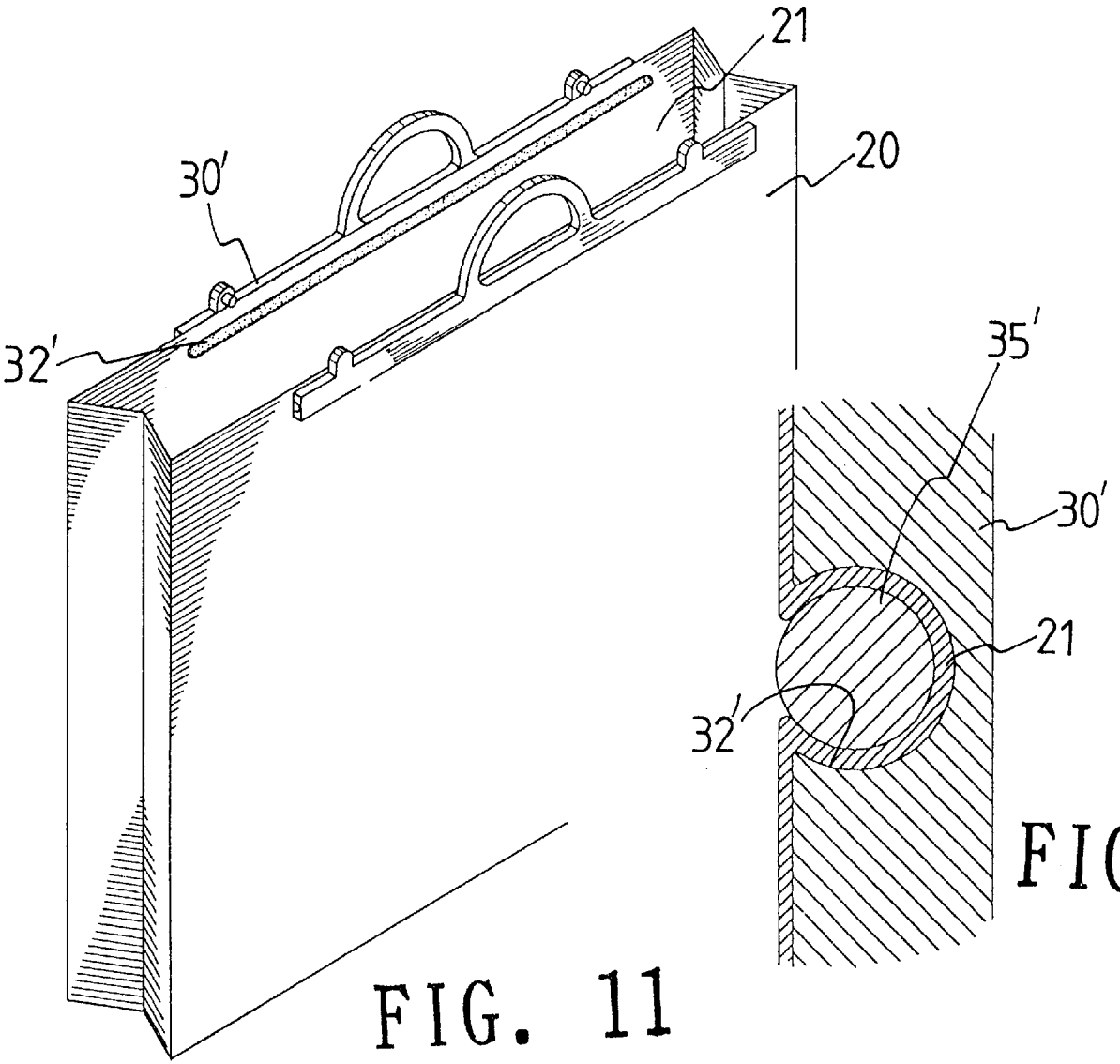
FIG. 11 is a perspective view to show the handle as shown in FIG. 10 connected to the bag.
FIG. 12 is a side elevational view to show the combination of the handle as shown in FIG. 10.

FIGS. 10 to 12 show yet another embodiment of the handle wherein the first plate 30' has a groove 32' but no the second plate as shown in FIG. 4. A stick 35 is fitted in the groove 32' so as to secure the top edge 21 of the bag 20 in the groove 32'.

The handle of the present invention has a simple structure and is easily connected to the bag without using heating means so that the assembling cost will be reduced.

The invention is not limited to the above embodiment but various modification thereof may be made. It will be understood by those skilled in the art that various changes in form and detail may made without departing from the scope and spirit of the present invention.

What is claimed is:

1. A handle for a bag, comprising:

two parts and each part adapted to be connected to one of two opposite top edges of the bag, each part having a first plate having a grip member connected thereto and a groove defined in a side of said first plate, said groove adapted to receive a top edge of the bag therein, two extensions extending from two ends of said first plate, each extension having a recess defined therein and a tab pivotally connected thereto, each tab having a boss extending therefrom so as to be engaged with said recess, and a stick fitted in said groove so as to be adapted to clamp the top edge of the bag in said groove.

2. The handle as claimed in claim 1 further comprising a second plate pivotally connected to said first plate and said stick extending from said second plate.

* * * * *